US006418691B1

(12) United States Patent
Stroppiana

(10) Patent No.: US 6,418,691 B1
(45) Date of Patent: Jul. 16, 2002

(54) FLOORING

(75) Inventor: Fernando Stroppiana, Grinzane Cavour (IT)

(73) Assignee: Mondo S.p.A., Cuneo (IT)

( * ) Notice: Subject to any disclaimer, the term of this patent is extended or adjusted under 35 U.S.C. 154(b) by 0 days.

(21) Appl. No.: 09/695,190

(22) Filed: Oct. 24, 2000

(30) Foreign Application Priority Data

Oct. 26, 1999 (IT) ..... T099A0929

(51) Int. Cl.[7] ..... E04B 5/43

(52) U.S. Cl. ..... 52/480; 52/403.1; 52/478; 52/482; 52/745.21; 52/746.1

(58) Field of Search ..... 52/403.1, 478, 52/480, 482, 511, 782.1, 799.1, 745.21, 746.1

(56) References Cited

U.S. PATENT DOCUMENTS 1,750,039 A * 3/1930 Feltes ..... 52/480
2,573,482 A * 10/1951 Peik ..... 52/403
2,859,334 A * 11/1958 Guth ..... 52/403
3,313,074 A * 4/1967 Huntley ..... 52/480
4,436,274 A * 3/1984 Kramer ..... 248/633
4,694,627 A * 9/1987 Omholt ..... 52/390
4,802,591 A * 2/1989 Iower et al. ..... 209/680
4,854,099 A * 8/1989 Kristoffersen ..... 52/403
4,945,697 A * 8/1990 Ott et al. ..... 52/396
4,945,858 A * 8/1990 Myers et al. ..... 119/28
6,199,335 B1 * 3/2001 Brenot et al. ..... 52/480

* cited by examiner

*Primary Examiner*—Carl D. Friedman
*Assistant Examiner*—Phi Dieu Tran A
(74) *Attorney, Agent, or Firm*—TraskBritt

(57) ABSTRACT

The flooring includes a treading layer extending in a given plane, and supporting formations extending from the treading layer along respective directions of extension, in which at least some of the supporting formations extend with their respective direction of extension, which is oblique with respect to the given plane of the treading layer. The supporting formations include first supporting formations in the form of a first array of ribs, which are substantially parallel to one another and extend from said treading layer with their respective directions of extension, which are oblique with respect to the given plane of the treading layer, and second supporting formations include a second array of ribs, which extend from the treading layer in a substantially orthogonal direction with respect to the given plane of the treading layer and are set crosswise with respect to the first array of ribs.

16 Claims, 2 Drawing Sheets

FLOORING

The present invention relates to floorings.

Floorings of the type specified above have, over the years, found extensive use in a very wide range of applications. A particularly extensive sector of use is that of floorings for sports and athletics facilities, the two terms "sports" and "athletics" being here used in their widest acceptation, i.e., also comprising installations such as gymnasia or fitness centres or medical centres, surgeries for carrying out medical examinations on sportsmen, etc.

Figure 1:
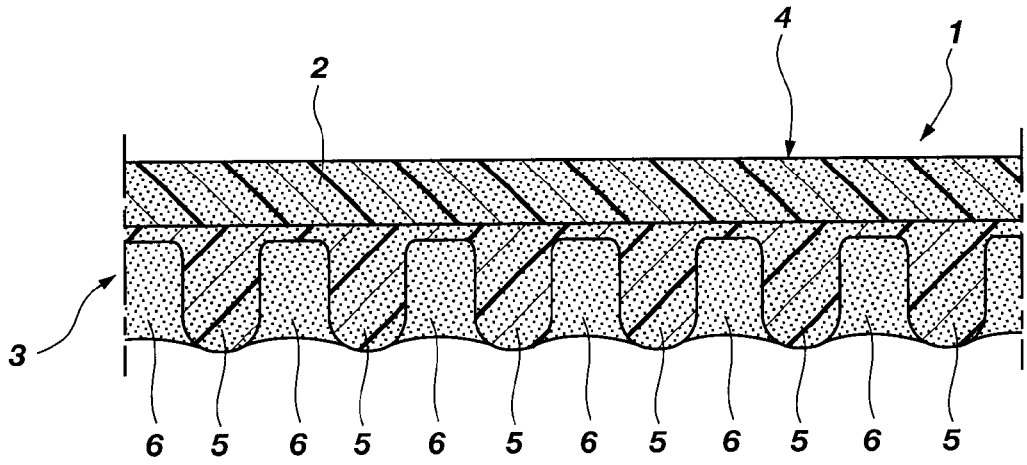
Fig. 1 (PRIOR ART)

FIG. 1 represents an ideal vertical cross section of a flooring according to the prior art. In particular, it is the flooring sold under the trade name SPORTFLEX SUPER X™ by the present applicant.

The flooring in question consists of a generally laminar or sheet-like 1, in which it is possible to distinguish:

- a treading layer 2 designed to face upwards in normal conditions of laying of the flooring 1; and
- an ensemble of supporting formations 3, in general presenting a structure that may be defined as pedunculate.

In practice, the flooring 1 is made, for example, starting from mixtures of isoprene rubber by means of one or more cascaded calendering operations. In this way it is possible to provide on the upper face 4 of the treading layer 2 with a generally corrugated pattern, which is primarily aimed at providing a non-slip surface. The ensemble of supporting formations 3 usually takes the form of a reticulated-type structure comprising one first array made up of a series of ribs 5 connected together by a second array formed by respective ribs 6, which are orthogonal to the former ones and which basically resemble formations that extend like bridges connecting adjacent ribs 5.

In the specific solution according to the prior art illustrated in FIG. 1, the height or depth of the bridges 6 (with respect to the general plane of extension of the treading surface 2) is slightly smaller than that of the ribs 5.

The characteristics of a flooring of the type described above can be identified in a quantitatively precise way by resorting to the elastic impact test according to the DIN 18035/6 Standard. This standard, in agreement with the DIN 18032/2 Standard, makes it possible to define a parameter, referred to as KA (abbreviation of the German word Kraftabbau), which substantially corresponds to a characterization, in percentage terms, of the behaviour of the flooring subjected to the fall of a weight of standard dimensions with respect to the behaviour of a rigid plane, typically a cement floor, when subjected to the same impact.

The floorings designed to be used in gymnasia generally have a KA coefficient of between 15–20% and 30–50%. The lower value of the aforesaid range corresponds to a flooring that can be characterized as rather "hard", whereas the upper limit corresponds to a flooring that proves somewhat "soft" in regard to the loads to which it is subjected.

In EP-A-0 913 524, a flooring is described which, re-proposing a structure that is basically similar to the one illustrated in FIG. 1, is characterized in that at least some of the supporting formations namely, the ribs 5) extend with their respective direction of extension monotonically oblique (usually at an angle of between 25° and 50° approximately) with respect to the plane of the treading layer 2.

In this way, it is possible to make a flooring that presents characteristics of compliance with respect to the stress exerted by an athlete who is running on a flooring that is differentiated according to the direction in which he is proceeding.

The present invention deals specifically with the problem of making a flooring of the type currently preferred to as "free laid", i.e., a flooring designed to be applied on a substrate without the application of means of adhesive connection to the substrate itself. It may, for example, be a flooring designed for being laid in a gymnasium without a specific preparation of the foundation (for example, because it is laid on an underlying flooring) and/or because the aim is to have available a flooring which, if desired, can be removed. To provide a concrete example, it may be a flooring that is generally soft, and hence with high compliance, designed for being temporarily laid, for carrying out particular exercises or types of sports, on an underlying floor that is generally hard or rigid (for instance, a playground for playing basket ball or volley ball).

A typical problem linked to the use of free-laid floorings is related to the need for ensuring a sufficiently firm anchorage of the flooring on the substrate in order to prevent, for instance, the flooring (which is not adhesively anchored to the substrate) from sliding with respect to the substrate when subjected to loadings according to the principal direction of extension.

To overcome this drawback, it is possible to think of configuring the formations for supporting the flooring in the form of sucker-type structures making up an array of small feet designed to support and anchor the flooring to the substrate.

This solution, however, presents three fundamental drawbacks.

In the first place, the elements acting at the same time as feet and as suckers, with their discretized distribution, exert an action of support likewise discretized for the treading layer. When the latter is, as frequently occurs, quite soft and compliant in itself, the result is that the person walking on the flooring wearing rather light footwear or in bare feet clearly perceives the presence and discrete distribution of the supporting feet underneath the flooring.

In the second place, this solution presents the drawback of offering a good resistance to the undesired sliding of the flooring on the substrate only as long as a very high percentage of feet/suckers are performing the desired function of anchoring the flooring to the substrate. If, for any reason (for example, owing to the undesired lifting of an edge or a corner of the flooring, if accessible), a substantial percentage of the feet located there lose the sucker-type relationship of co-operation with the substrate, there exists a high likelihood of this phenomenon rapidly extending towards other areas of the flooring as soon as an appreciable sliding stress takes place.

A third drawback is linked to the fact that the characteristics of anchorage to the substrate, provided basically by the characteristics (shape, size, and distribution) of the feet functioning as suckers, play an important role in establishing the degree of compliance of the flooring, so that this degree of compliance ends up by being affected—frequently in an undesired way—by the characteristics of connection to the substrate that it is intended to achieve.

The object of the present invention is to provide a flooring of the type specified above having characteristics of a free-laid flooring in which the above-mentioned problems are overcome.

According to the present invention, this object is achieved thanks to a flooring having the characteristics specified in the following claims. The invention also regards the corresponding process of fabrication.

Figure 2:
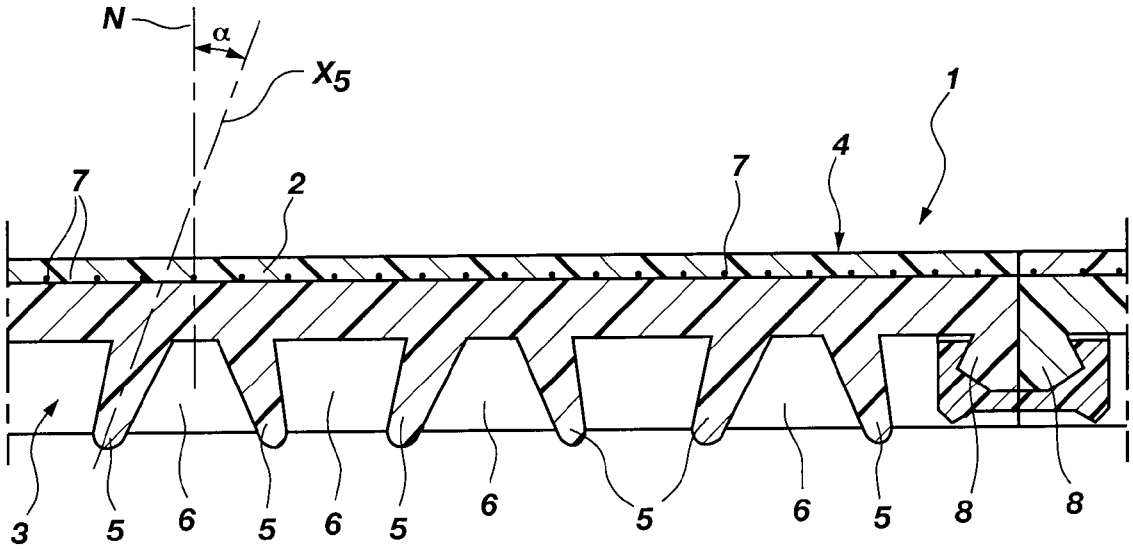
Figure 3:
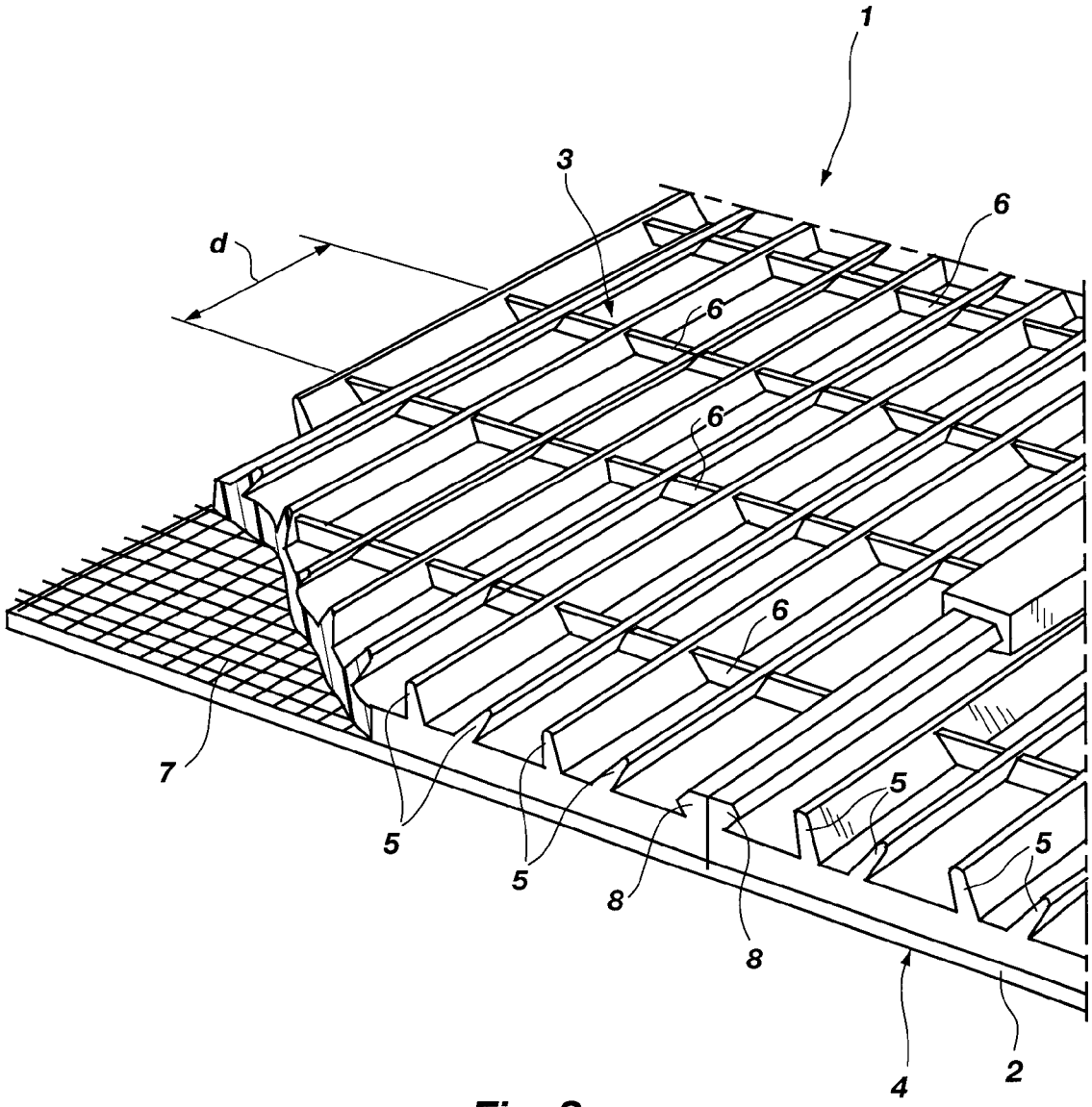

The invention will now be described, purely by way of non-limiting example, with reference to the attached drawings, which:

FIG. 1, which refers to the prior art, has already bee described previously;

FIG. 2 illustrates, in a sectional view substantially corresponding to the sectional view of FIG. 1, the characteristics of a flooring made according to the present invention; and FIG. 3 illustrates, in an overall perspective view of a flooring according to the invention, the underside surface which is designed to face the substrate on which the flooring is laid.

In FIGS. 2 and 3, the same reference numbers as the ones a ready used for the description of FIG. 1 are used to designate parts or elements that are identical or functionally equivalent to those already described with reference to FIG. 1.

As may be appreciated by a comparison between FIG. 1 and FIG. 2, an important characteristic of the solution according to the invention is provided by the fact that the ribs 5 are not arranged with their principal direction of extension orthogonal with respect to the treading layer 2, but rather generically inclined with respect to that layer. By "direction of extension" is of course meant the direction along which the ribs 5 (or, more precisely, their cross-sectional profiles) extend as they depart from the treading layer 2.

In particular, the ribs 5 extend with their respective direction of extension oblique with respect to the surface of the treading layer. More precisely, the ribs 5 are arranged with their general direction of extension X5 forming an angle $\alpha$ with respect to the direction of the normal N to the general plane of extension of the treading layer 2. The value of the angle $\alpha$ is chosen within a range which typically extends from about 10° to about 30°, with a preferential choice of between about 18° and about 20°.

In particular, it may be noted that in the embodiment at present preferred the ribs 5 are not all inclined in the same direction (i.e., monotonically) with respect to the treading layer 2. Whilst the value of the angle $\alpha$ preferably remains within the range referred to above, the direction of inclination alternates; i.e., with the angle $\alpha$ that changes sign in an alternating sequence as the flooring is ideally traversed in its plane of extension and in a direction perpendicular to the direction of extension of the ribs 5.

At least in principle, the sequence of alternation of the angle of inclination could be different from the one illustrated, in which each rib 5 presents a direction of inclination opposite to that of the two adjacent ribs 5 (that is, if we refer to the sign of the angle a, the sequence to which FIG. 2 refers is a sequence of the type $+\alpha$, $-\alpha$, $+\alpha$, $-\alpha$, etc.). The sequence of alternation could be, however, of a different type, for example with pairs of adjacent ribs 5 having a direction of inclination that is the same, set between pairs of adjacent ribs having an opposite direction of inclination (i.e., following a sequence of the type $+\alpha$, $+\alpha$,$-\alpha$, $-\alpha$, $+\alpha$, $+\alpha$, $-\alpha$, $-\alpha$, etc.). Of course, also non-symmetrical sequences of alternation could be proposed (for example, $+\alpha$, $-\alpha$, $-\alpha$, $+\alpha$, $-\alpha$, $-\alpha$, etc.).

More in general still, also the fact that there is an alternation in the direction of inclination, albeit constituting a preferential characteristic, does not represent an indispensable element of the invention.

Hence, the ribs 5 could also be all inclined in the same direction, as is envisaged in the solution described in EP-A-0 913 524.

As compared to the solution described in this previous application and also to the solution according to the prior art represented in FIG. 1, the solution according to the present invention, as this is represented in FIG. 2, also presents the further characteristic given by the fact that the ribs 5 are, as a whole, quite slender, and hence thin above all at their distal margins, which are designed to co-operate directly with the substrate on which the flooring is laid. It will be appreciated that distal margins of this kind are usually at least slightly protruding with respect to the corresponding margins of the ribs 6.

Preferably, the necessary characteristics of slenderness, and hence of flexibility, referred to above are achieved by giving to the ribs 5 a generally tapered pattern (preferably with a triangular profile, or quasi-triangular profile), which makes it possible (to provide an immediately perceptible reference) to liken them to the lip parts of windscreen-wiper blades.

In this way, it is possible to make the ribs 5, and in particular their distal parts, so that they bend (thanks to their general inclined arrangement) as soon as the flooring 1 is laid on the corresponding substrate in order to achieve a lip connection with the substrate itself, the purpose being to get each portion of the bottom face of the flooring 1 (see FIG. 3) between two adjacent ribs 5 and two correspondingly adjacent ribs 6 to constitute a sucker-type formation (of a generally rectangular shape, in the embodiment illustrated) that is able to co-operate with the substrate so as to provide firm anchorage of the flooring 1 on the substrate itself even in the absence of an adhesive layer (hence, working in conditions of free laying).

It will be appreciated that the above-mentioned sucker effect is obtained both in the regions of the underside of the flooring delimited by diverging ribs 5 and in the portions delimited by converging ribs 5. It is very likely (the applicant has, however, at the moment not conducted specific investigations into the matter) that the action occurs to a slightly greater extent at the sections delimited by divergent ribs 5.

In any case, it will be appreciated that the effect of sucker-type co-operation with the substrate develops on the underside of the flooring (the one more clearly visible in FIG. 3) over the entire development of the flooring itself, hence preventing the drawbacks illustrated in the introductory part as being linked to the use of foot-type formations.

Since the ribs 5 are arranged generically inclined with respect to the treading layer 2 and are preferably slender at least in their distal parts, they afford a rather limited resistance to the loads applied vertically on the flooring 1 starting from the treading layer 2. It may thus be said that the ribs 5 play a generally modest role in defining the overall characteristics of compliance of the flooring 1.

This role is instead performed by the other ribs 6, which extend in a direction orthogonal to the ribs 5, preferably both in a direction orthogonal to the ribs 5 themselves and at fixed distances apart, said distances being identified by d in FIG. 3.

In this connection, it is to be noted that this specific embodiment, although at the moment preferred, is of itself not imperative for the purposes of the implementation of the invention, given that the ribs 6 could extend also in inclined directions (for example, following a zigzag or serpentine pattern) with respect to the ribs 5, which could be distributed also at non-uniform distances apart, possibly to vary selectively the characteristics of compliance of the flooring from one area to another.

In any case, for reasons of simplicity of illustration, the principle lying at the basis of the invention will now be illustrated with reference to the embodiment shown in FIGS. 2 and 3.

As has already been said, both on account of their inclined arrangement and on account of their slenderness, the ribs 5 do not play a determining role in identifying the characteristics of compliance of the flooring 1. These characteristics are, instead, identified by the ribs 6, and in particular by the profile and spatial distribution of the same.

The ribs 6 extend in a direction orthogonal to the treading layer 2, consequently not in an inclined direction as do the ribs 5. Furthermore, they present a preferably more massive structure, as compared to the ribs 5.

This means that the mechanism of reaction of the ribs 6 with respect to the vertical loading stresses applied on the flooring 1 is substantially different from that of the ribs 5. The ribs 6 are, in fact, loaded perpendicularly as a result of the stress applied on the flooring, and hence primarily determine, on account of their characteristics of deformation (cross section, profile, constitutive material, etc.) and their spatial distribution (basically their distribution density, and hence the distance d), the characteristics of compliance of the flooring.

The fact that the aforesaid characteristics are identified primarily by the ribs 6 makes possible a convenient experimental check, since it can in fact be verified that, all other factors being equal (and, in particular, given the same dimensions, distribution, density, and angle of inclination of the ribs 5), it is possible to get the degree of compliance of the flooring 1 to vary in a controlled manner by intervening solely on the distribution density of the formations 6 (for example, on their distance apart d) and/or on the characteristics of deformability of the formations 6 themselves.

The experiments carried out by the applicant show that this result is achieved in an even more effective way by setting a stabilization structure 7 between the treading layer 2 and the ensemble of supporting ribs 3, the said stabilization structure 7 consisting, for example, of a stabilizing mesh made up, for instance, of polyolefin fibres, such as polyester fibres.

In addition to exerting, in accordance with criteria known in themselves, a stabilizing action in regard to the treading layer 2, the stabilization structure 7 unexpectedly plays a significant role in causing the characteristics of compliance of the flooring to be dictated primarily by the ribs 6. Albeit not wishing to tie down to any specific theory in this regard, the applicant believes that this action is very probably linked to the fact that the stabilization structure 7, characterized primarily by a considerable resistance to tensile stresses, is able to perform an action of connection between adjacent ribs 6, so favouring the uniform distribution of the stresses applied to the ribs themselves as a result of a load that bears upon the flooring 1.

On the other hand, the stabilization structure 7 with all likelihood plays a similar role also in regard to the ribs 5 by causing the action of connection to the substrate achieved by the ribs 5 to be exerted in an extremely uniform way over the entire development of the flooring 1, further preventing the risk of occurrence of undesired phenomena of local detachment from the floor foundation.

Preferably, the flooring 1 according to the invention is made starting from mixtures of synthetic rubbers through one or more cascaded calendering operations.

In particular, the flooring in question may be obtained using the same materials currently used for making similar floorings according to the prior art, applying a process of single-layer or multi-layer calendering generally identical to those adopted for producing floorings according to the known art.

Of course, in the presently preferred embodiment of the invention, it is necessary to envisage the step of inserting a mesh functioning as a stabilization structure 7. In any case, the insertion of such a structure is carried out according to known criteria, such as not to require a specific description herein.

In particular, a flooring of the type illustrated in FIGS. 2 and 3 may be made using the same materials currently used for making similar floorings according to the prior art (in this connection, see what has been said in the introductory part of the present description with reference to FIG. 1), adopting a single-layer or multi-layer calendering process that is basically identical to those used for the production of floorings according to the prior art. The result of providing the ribs, and in particular the ribs 5 (as has been seen, the ribs 6 conserve a pattern that is generically orthogonal to the treading layer 2) with the desired angle may be obtained according to a solution that has been tested with complete success by the applicant, simply by providing, as regards the calendering roller for sculpturing the supporting ribs 3, grooves or slits corresponding to and complementary to the ribs 5 having their principal direction of extension, in the direction of depth, oriented in a direction that is at least slightly skewed with respect to the corresponding diameter of the calendering roller.

Purely to provide a non-limiting indication, the flooring 1 illustrated in FIG. 1 may present the following characteristics:

- thickness (measured between the surface 4 of the treading layer 2 and the distal margins of the ribs 5): 12.5 mm;
- overall thickness of the assembly made up of the treading layer 2 and the plane part comprised between the ribs 5 and 6: 6–7 mm;
- dimensions and shape of the plane of section of the ribs 5: basically resembling a scalene triangle having a base of 3.5 mm, and a distance between the centre of the base and the vertex of approximately 6 mm; and
- inclination of the principal axis of the ribs with respect to the treading layer 2 (angle $\alpha$ in FIG. 2): approximately 18.5°.

The ensuing Table 1 gives the various values of compliance (i.e., the coefficient KA measured according to the DIN 18032/2 Standard) measured for the flooring 1 having the characteristics specified above, obtained starting from a mix comprising, for the treading layer 2, a mixture of synthetic rubber (hardness, approx. 70 Shore A), and for the supporting formations 3, a mixture of synthetic rubber (hardness approx. 55 Shore A), with the interposition of a polyester-fibre mesh 7 between the two layers.

In particular, the various values of compliance were measured as a function of different values of the distance of separation (d in FIG. 3) between the ribs 6, referring to ribs 6 having a height (measured in a direction orthogonal to the treading layer 2) of approximately 6 mm, and a width of the base of 3 mm with a pattern that is at least slightly tapered towards the distal margin.

TABLE 1

| DISTANCE d (mm) | % KA |
|---|---|
| 20 | 29 |
| 25 | 32 |
| 30 | 36 |
| 35 | 37.5 |
| 40 | 39 |

The various samples of flooring made according to the criteria described above have shown, on the other hand, a substantially identical behaviour as regards anchorage to the substrate (achieved by free laying, hence without any adhesive connection) and an absolutely homogeneous behaviour as regards compliance over the entire surface of the flooring, and consequently without the formation of more or less resistant surface areas that might possibly be detected by treading.

From what has been described herein it is evident that the solution according to the invention enables the characteristics of compliance of the flooring to be rendered altogether independent of the characteristics of interaction with the substrate on which the flooring is laid, with the consequent possibility of varying selectively, even with a high degree of precision, the values of compliance, it being possible moreover to rely on a behaviour of the flooring determined and reproducible in a deterministic way as regards the characteristics of laying and of interaction with the substrate.

It has in particular been possible to note that, at the same time as being able to count on a complete interaction, as well as an interaction that is distributed in a uniform way between the underside of the flooring 1 and the surface of the substrate on which the flooring is laid, the flooring according to the invention does not give rise to particular problems when it is required to remove the flooring by lifting it up from the substrate. The flooring may in fact be easily removed simply by lifting up the sheets of which it is normally made at one side and rolling it up gradually. This is possible in so far as the sucker-type relationship of co-operation with the substrate described previously is achieved primarily (in a precise and reliable way) when the flooring is subjected to loads, in particular to treading loads, without there being, on the other hand, any undesired residual phenomena of connection of interaction when the flooring, when not subjected to loads, is to be removed.

From the foregoing it is evident that the invention enables an assortment of floorings to be obtained characterized by different values of compliance depending primarily upon a different characteristic of at least one property of the ribs of said second array 6, the floorings 1 of the assortment being, otherwise, basically identical to one another.

Preferably, as has been seen previously, the said at least one characteristic of a property is represented by the spatial density of the ribs of the second array 6.

Preferably, the flooring according to the invention is made in the form of sheets, for example having a width of approximately 130 cm. The sheets, set side by side when the flooring is laid, may then be connected together by means of elements, for instance of plastics material (polypropylene, polyethylene, etc.) having a C-shaped cross section or the like, designed to co-operate with respective pairs of protruding ribs 8 made on the bottom face of the flooring along the longitudinal edges of the sheets, as illustrated in FIG. 3.

Of course, without prejudice to the principle of the invention, the details of construction and the embodiments may vary widely with respect to what is described and illustrated herein, without thereby departing from the scope of the invention.

What is claimed is:

1. A flooring comprising a treading layer extending in a given plane, and supporting formations which extend from said treading layer along respective directions of extension, in which at least some of said supporting formations extend with their respective direction of extension, which is oblique with respect to said given plane of the treading layer, wherein said supporting formations comprise:

first resilient supporting formations in the form of a first array of ribs, which are substantially parallel to one another and extend from said treading layer with their respective directions of extension, which are oblique with respect to said given plane of the treading layer; and second resilient supporting formations consisting of a second array of ribs which extend from said treading layer in a substantially orthogonal direction with respect to said given plane of the treading layer and are set crosswise with respect to said first array of ribs so as to form a texture of cells adapted to co-operate in a sucker-type relationship with the substrate on which the flooring is laid, the configuration being such that the characteristics of compliance of the flooring are determined primarily by said second array of ribs.

2. The flooring according to claim 1, wherein the ribs of said first array extend with their respective directions of extension oblique with respect to said given plane of the treading layer according to an alternating sequence of angles of inclination ($\alpha$) of opposite signs.

3. The flooring according to claim 2, wherein in said alternating sequence each of the ribs of said first array is flanked by two ribs of said first array having an opposite direction of inclination.

4. The flooring of claims 1, wherein the ribs of said first array present thin distal parts defining lips of co-operation by deformation with the substrate on which the flooring is laid.

5. The flooring according to claim 1, wherein the ribs of said first array have a general tapered pattern starting from said treading layer.

6. The flooring according to claim 1, wherein the ribs of said second array have a height with respect to said given plane of the treading layer smaller than the homologous height of the ribs of said first array.

7. The flooring according to claim 1, wherein between said treading layer and said supporting formations, a laminar load distributing structure is provided.

8. The flooring according to claim 7, wherein said structure is a net-like structure.

9. The flooring according to claim 7 wherein said laminar load distributing structure has a polyolefin base, such as polyester.

10. The flooring according to claim 1, wherein at least said supporting formations consist of an elastomer mass.

11. The flooring according to claim 10, wherein both said treading layer and said supporting formations consist of an elastomer mass.

12. The flooring according to claim 1, wherein at least said treading layer consists of a mass of calendered material.

13. The flooring according to claim 1, in the form of sheets provided with longitudinal edges presenting, at said supporting formations (5, 6) protruding ribs (8) adapted to be connected with similar ribs (8) of adjacent sheets.

14. The flooring according to claim 1, wherein said respective directions of extension of said first supporting formations are inclined with respect to said given plane by an angle ($\alpha$) of between 10° and 30°, and preferably between 18° and 20°.

15. An assortment of floorings including a plurality of floorings, each flooring comprising a treading layer extending in a given plane, and supporting formations which extend from said treading layer along respective directions of extension, in which at least some of said supporting formations extend with their respective direction of extension, which is oblique with respect to said given plane of the treading layer, wherein said supporting formations comprise:

first resilient supporting formations in the form of a first array of ribs, which are substantially parallel to one another and extend from said treading layer with their respective directions of extension, which are oblique with respect to said given plane of the treading layer; and second resilient supporting formations consisting of a second array of ribs which extend from said treading layer in a substantially orthogonal direction with respect to said given plane of the treading layer and are set crosswise with respect to said first array of ribs so as to form a texture of cells adapted to co-operate in a sucker-type relationship with the substrate on which the flooring is laid, the configuration being such that the characteristics of compliance of the flooring are determined primarily by said second array of ribs, and wherein the floorings of the assortment being characterized by different values of compliance primarily depending upon a different characteristic of at least one property of the ribs of said second array, the floorings of the assortment being otherwise basically identical to one another.

16. The assortment of floorings according to claim 15, wherein said at least one characteristic of said property is the spatial density of the ribs of said second array.

* * * * *